US010736477B2

(12) United States Patent
Kim et al.

(10) Patent No.: US 10,736,477 B2
(45) Date of Patent: Aug. 11, 2020

(54) REMAINING WATER SUCTION DEVICE

(71) Applicant: LG ELECTRONICS INC., Seoul (KR)

(72) Inventors: Seongho Kim, Seoul (KR); Jong Seok Kim, Seoul (KR); Inhyung Yang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 201 days.

(21) Appl. No.: 15/695,603

(22) Filed: Sep. 5, 2017

(65) Prior Publication Data

US 2018/0070784 A1 Mar. 15, 2018

(30) Foreign Application Priority Data

Sep. 13, 2016 (KR) ..... 10-2016-0118271

(51) Int. Cl.
*A47L 7/00* (2006.01)
*A47L 11/40* (2006.01)
(Continued)

(52) U.S. Cl.
CPC ..... *A47L 7/0023* (2013.01); *A47L 7/0009* (2013.01); *A47L 11/4044* (2013.01); *A47L 1/05* (2013.01); *A47L 11/38* (2013.01); *A47L 11/4011* (2013.01)

(58) Field of Classification Search
CPC .. A47L 7/0023; A47L 7/0009; A47L 11/4044; A47L 5/00; A47L 5/06; A47L 7/00; A47L 7/0004; A47L 9/068; A47L 11/4013; A47L 1/05; A47L 1/06; A47L 7/009; A47L 11/30; A47L 11/34;
(Continued)

(56) References Cited

U.S. PATENT DOCUMENTS 4,168,563 A * 9/1979 O'Bryan ..... A47L 11/34 15/321
4,464,810 A * 8/1984 Karpanty ..... A47L 11/30 15/320
(Continued)

FOREIGN PATENT DOCUMENTS

CN 1942129 4/2007
CN 102670138 9/2012
(Continued)

OTHER PUBLICATIONS

Chinese Office Action dated Oct. 10, 2019 issued in CN Application No. 201710813856.4.

*Primary Examiner* — Brain D Keller
(74) *Attorney, Agent, or Firm* — KED & Associates LLP

(57) ABSTRACT

A remaining water suction device may include: a suction nozzle, a water separation chamber configured to be connected to a discharge port of the suction nozzle and provided with a water discharge port and an air discharge port, and a buffer tank configured to be connected to the water discharge port and store water separated from the water separation chamber. The remaining water suction device may include a water transfer pump configured to transfer the water stored in the buffer tank, a water storage tank configured to store the water transferred through the water transfer pump, a suction fan configured to provide a suction force to the air discharge port, and a suction motor configured to drive the suction fan.

13 Claims, 9 Drawing Sheets

(51) Int. Cl.
*A47L 1/05* (2006.01)
*A47L 11/38* (2006.01)

(58) Field of Classification Search
CPC .... A47L 11/4016; A47L 11/4027; A47L 5/24; A47L 9/11; A47L 9/4013
USPC ..... 15/320, 300.1, 344, 327.1
See application file for complete search history.

(56) References Cited

U.S. PATENT DOCUMENTS 5,826,298 A * 10/1998 Rohrbacher ..... A47L 11/38 15/321
6,658,693 B1 * 12/2003 Reed, Jr. ..... A47L 5/26 15/321
6,968,593 B1 * 11/2005 Lenkiewicz ..... A47L 5/26 15/320
7,225,503 B1 * 6/2007 Lenkiewicz ..... A47L 5/24 15/320
7,429,319 B2 * 9/2008 Davis ..... B08B 9/04 134/104.4
2012/0023698 A1 * 2/2012 Durrant ..... A47L 11/34 15/319
2016/0016205 A1 * 1/2016 Bonneau ..... B08B 3/026 134/10
2016/0066756 A1 * 3/2016 Walker ..... A47L 9/0606 15/322
2016/0128528 A1 * 5/2016 Stewen ..... A47L 1/05 15/344

FOREIGN PATENT DOCUMENTS

CN 103327869 9/2013
CN 103479306 1/2014
EP 2 868 249 5/2015
WO WO 2013/143616 10/2013

* cited by examiner

REMAINING WATER SUCTION DEVICE

CROSS-REFERENCE TO RELATED APPLICATION

This application claims priority to and benefit of Korean Patent Application No. 10-2016-0118271, filed Sep. 13, 2016, the subject matter of which is incorporated herein by reference.

BACKGROUND

1. Field

The present disclosure relates to a remaining water suction device for sucking and removing remaining water on a window or a wall surface. More particularly, the present disclosure relates to a handy type remaining water suction device that can be used to remove remaining water on a bathroom wall or a bathroom floor by providing a structure to be used in an upright position or a laid-down position.

2. Background

When cleaning a window or a wall surface of a building, a detergent and a large amount of washing water may be used. If the washing water remaining on the surface of the window is not wiped off, then dust (or the like) may adhere to the washing water and re-contamination may easily occur.

A remaining water suction device is a device for absorbing and removing water remaining on a window or a wall surface, for example.

FIG. 1 is a view of a remaining water suction device. Other arrangements may also be provided.

A remaining water suction device 10 may suck water through a suction port 12*a* by using a suction force of a suction pump (i.e., a suction pump 16 in FIG. 2), and the suctioned water may be stored in a water tank 15. The air, which is sucked together with the water, may be discharged through an exhaust port 18.

FIG. 2 is a view of an internal structure of a remaining water suction device in a state where water is removed from a wall surface by using the remaining water suction device. FIG. 3 is a view of an internal structure of a remaining water suction device in a state where water is removed from a floor by using the remaining water suction device. Other arrangements may also be provided.

Referring to FIG. 2, the remaining water suction device 10 may include a suction nozzle 12 having the suction port 12*a*, a water separation chamber 14 that separates water and air sucked through the suction nozzle 12, a water tank 15 that stores separated water from the water separation chamber 14, a suction fan 17 that provides a suction force to the water separation chamber 14, and a suction motor 16 that drives the suction fan 17.

The water separation chamber 14 may include a water discharge port 14*a* and an air discharge port 14*b*.

The water discharge port 14*a* may be connected to the water tank 15. The air discharge port 14*b* may be connected to the suction fan 17. The water discharged through the water discharge port 14*a* may be collected into the water tank 15 disposed in a lower portion of the water discharge port 14*a* due to flow of air and the gravity.

The air discharged through the air discharge port 14*b* may be expelled to the outside through the suction fan 17.

FIG. 2 shows an example of the remaining water suction device being used in a standing state for sucking the water from the wall surface 1 (or on the wall surface). The water tank 15 may have an elongated shape in the longitudinal direction.

Therefore, even if the remaining water suction device 10 is shaken or tilted when the water on the wall surface 1 is removed, the water in the water tank 15 may be prevented from flowing back to a side of the suction fan 17.

When the water tank 15 is full of water, the water may flow into the suction fan 17 due to shaking or tilting. This problem may be caused by improper use.

Referring to FIG. 3, when the water on (or in) the floor 2 is sucked by using the remaining water suction device 10, the water tank 15, which is long in the longitudinal direction, may be laid down in the horizontal direction.

There is a high possibility that the water stored in the water tank 15 may flow back to the water separation chamber 14 due to the tilting or the shaking that may occur during use of the water suction device 10.

The water that has flowed back to the water separation chamber 14 may flow into the air discharge port 14*b* together with air flow, and the water introduced into the air discharge port 14*b* may expel to the outside through the suction fan 17.

This problem may occur even when the water tank 15 is not filled with water. Accordingly, users may use the water tank 15 while frequently emptying the water tank 15 to prevent backflow when the water on the floor 2 is sucked.

BRIEF DESCRIPTION OF THE DRAWINGS

Arrangements and embodiments may be described in detail with reference to the following drawings in which like reference numerals refer to like elements and wherein.

DETAILED DESCRIPTION

Exemplary arrangements and embodiments may be described with reference to the accompanying drawings. The same reference numbers may be used throughout the drawings to refer to the same or like parts. Detailed descriptions of well-known functions and structures incorporated herein may be omitted to avoid obscuring subject matter.

Figure 4:
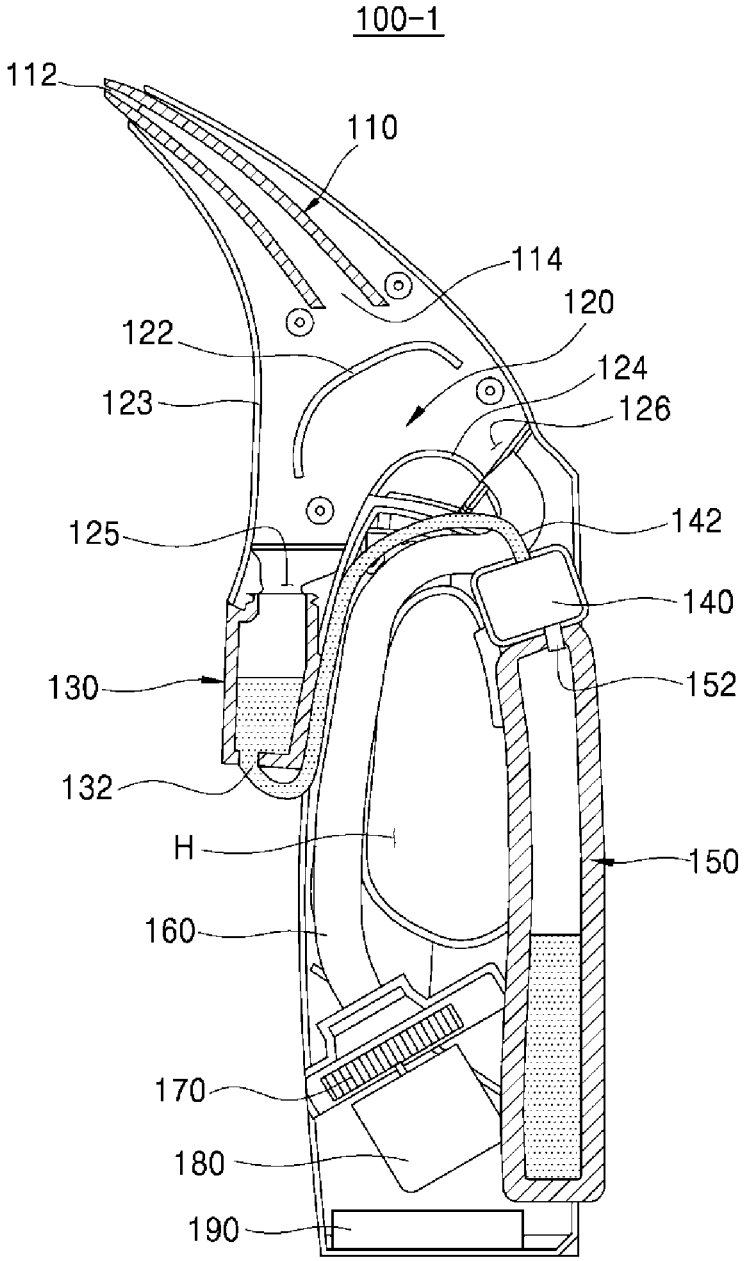
FIG. 4 is a cross-sectional view of a structure of a remaining water suction device according to a first embodiment.
Figure 5:
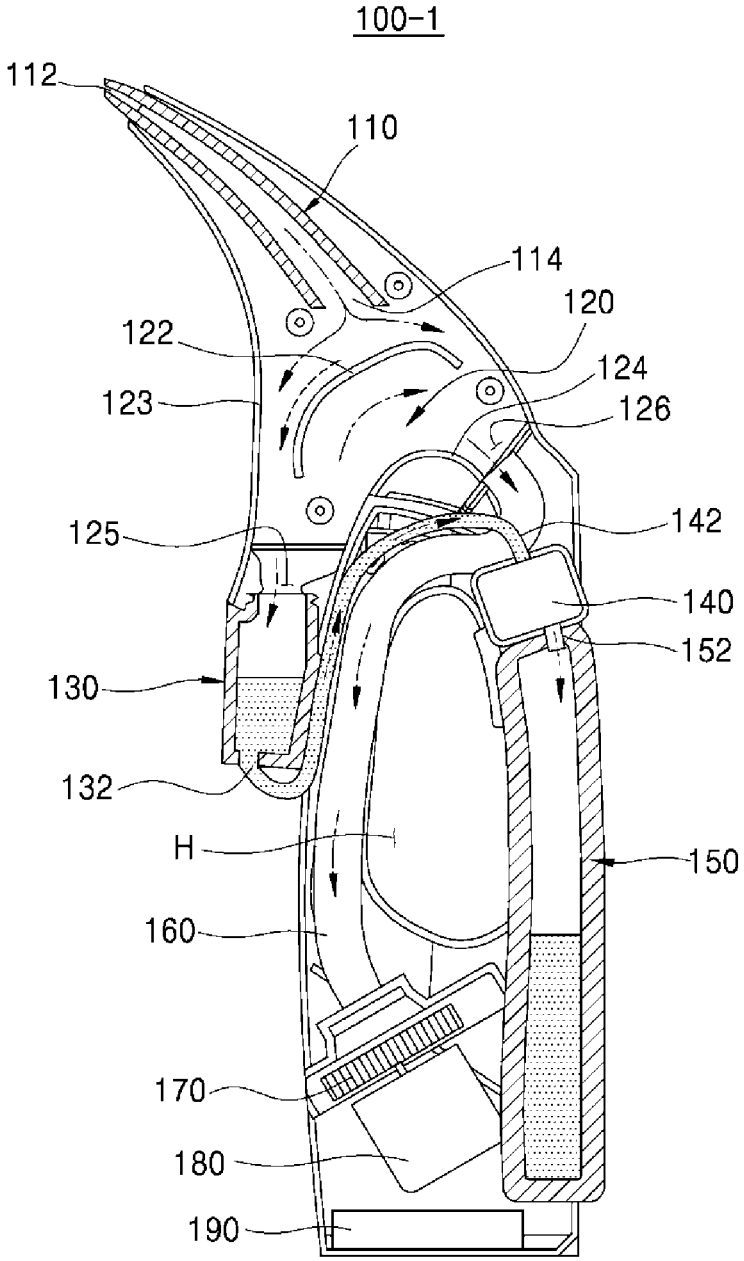
FIG. 5 is a view for explaining an operation principle of the remaining water suction device according to the first embodiment.

FIG. 4 is a cross-sectional view of a structure of a remaining water suction device according to a first embodiment. FIG. 5 is a view for explaining an operation principle of the remaining water suction device according to the first embodiment. Other embodiments and configurations may also be provided.

Figure 6:
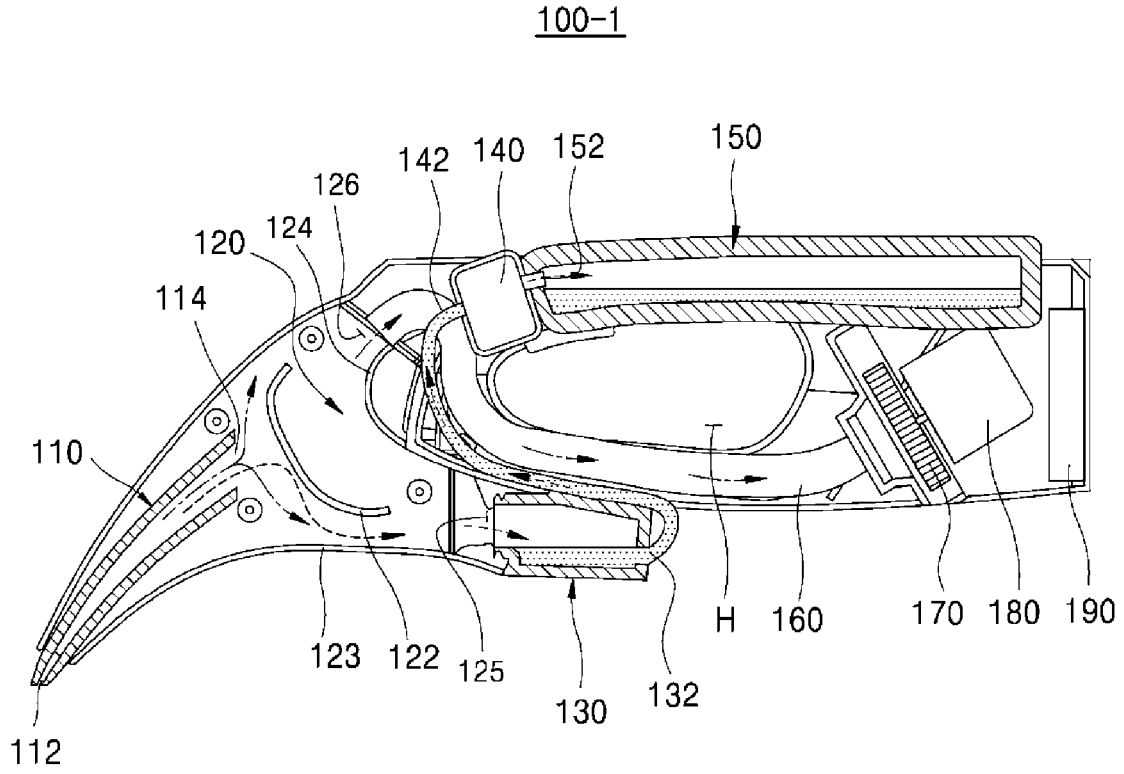
FIG. 6 is a view for explaining an operation in a laid-down state of the water suction device according to the first embodiment.

The remaining water suction device 100-1 (or water suction device) according to the first embodiment may be provided in a standing state (or standing position) as shown in FIGS. 4 and 5 when it is used for removing water on a wall surface. The water suction device 100-1 may be provided in a laid-down state (or laid-down position) as shown in FIG. 6 when it is used for removing water on a floor.

In the following description (including the claims), the description of positional relationship(s) of specific elements with respect to vertical and horizontal positions may be based on the state (or position) where the water suction device 100-1 is disposed in an upright position.

The water suction device 100-1 may include a suction nozzle 110, a water separation chamber 120, a buffer tank 130, a water transfer pump 140, a water storage tank 150, a suction fan 170, and a suction motor 180. The water suction device 100-1 may include other components, more components and/or less components.

The suction nozzle 110 may include a suction port 112 for sucking water and air, and a discharge port 114 for discharging a fluid (i.e., water and air) into the water separation chamber 120.

The suction nozzle 110 may have a tubular shape, for example. The suction port 112 (of the suction nozzle 110) may be formed in a straight slit shape to improve suction efficiency. If the suction port 112 is formed in a straight slit shape, the area for sucking water may be enlarged.

The suction port 112 may contact a wall surface or a floor when the remaining water is to be sucked. In order to prevent damage of the suction port 112 due to contact or damage of the wall surface (or the floor), a portion of the suction port 112 to contact the wall surface or the floor may be made of an elastic material.

The water separation chamber 120 may separate water and air which are mixed and sucked in through the suction nozzle 110. The water separation chamber 120 may be formed roughly as a triangular closed space. The water separation chamber 120 may be an internal space of the case itself forming an external appearance, and/or may be formed as a separate part.

Among three corners of the triangle of the water separation chamber 120, the suction nozzle 110 may be provided at an upper corner portion, and a water discharge port 125 and an air discharge port 126 may be provided at both corners of a lower portion, respectively.

The water separation chamber 120 may have a partition wall 122 therein. The partition wall 122 may be disposed in a direction between (or across) the water discharge port 125 and the air discharge port 126.

The partition wall 122 may be disposed at a lower position than the discharge port 114 (of the suction nozzle 110) in order to at least partially block a flow of the mixture of water and air that is flowing from the discharge port 114. Therefore, the mixture of water and air flowing from the discharge port 114 may collide with the partition wall 122.

The partition wall 122 may be downwardly inclined toward the water discharge port 125. This may allow the water colliding with the partition wall 122 to flow down the slope of the partition wall 122 and toward the water discharge port 125.

The water and the air may be sucked in a mixed state through the suction port 112 (of the suction nozzle 110). The mixture of the sucked water and air may be discharged to the discharge port 114 (of the suction nozzle 110), and collide with the partition wall 122. The water in the mixture that collides with the partition wall 122 may flow down the slope of the partition wall 122 and through the water discharge port 125 to the buffer tank 130. The water in the water separation chamber 120 may flow into the buffer tank 130 by the flow of air and the gravity inside the water separation chamber 120, and the water may be stored (or collected) in the buffer tank 130.

The air discharge port 126 (of the water separation chamber 120) may be connected to the suction fan 170 through a suction pipe 160. When the suction fan 170 operates and a suction force is generated in the suction pipe 160, air inside the water separation chamber 120 may be sucked into the air discharge port 126. The air sucked into the air discharge port 126 may be discharged by the suction fan 170.

The buffer tank 130 may be provided at a lower position than the water discharge port 125 (of the water separation chamber 120), and the buffer tank 13 may temporarily store the water flowing into the water discharge port 125. The water temporarily stored in the buffer tank 130 may be sent (or transferred) to the water storage tank 150 by the water transfer pump 140.

The water flowing into the buffer tank 130 may move due to the gravity and the air flow. However, the water stored in the buffer tank 130 may move to the water storage tank 150 based on power of the water transfer pump 140.

Since the buffer tank 130 temporarily stores water, the water storage capacity may be relatively small. On the other hand, since the water storage tank 150 is in charge of water storage capacity of the water suction device 100-1, the water storage tank 150 may be advantageous as the water storage capacity becomes larger.

Since the water separated from the water separation chamber 120 is separated and moved due to the flow of air and the gravity, the tank for storing water may be provided in a lower position than the suction nozzle 110.

Figure 1:
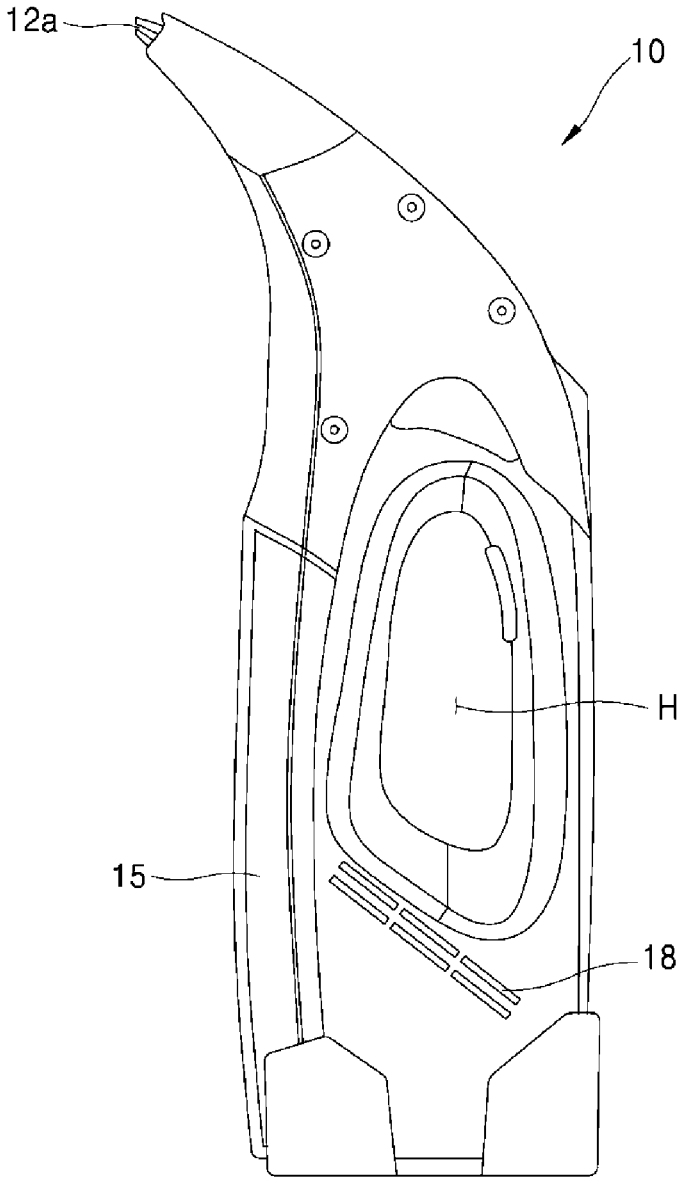
FIG. 1 is a view of a remaining water suction device.
Figure 2:
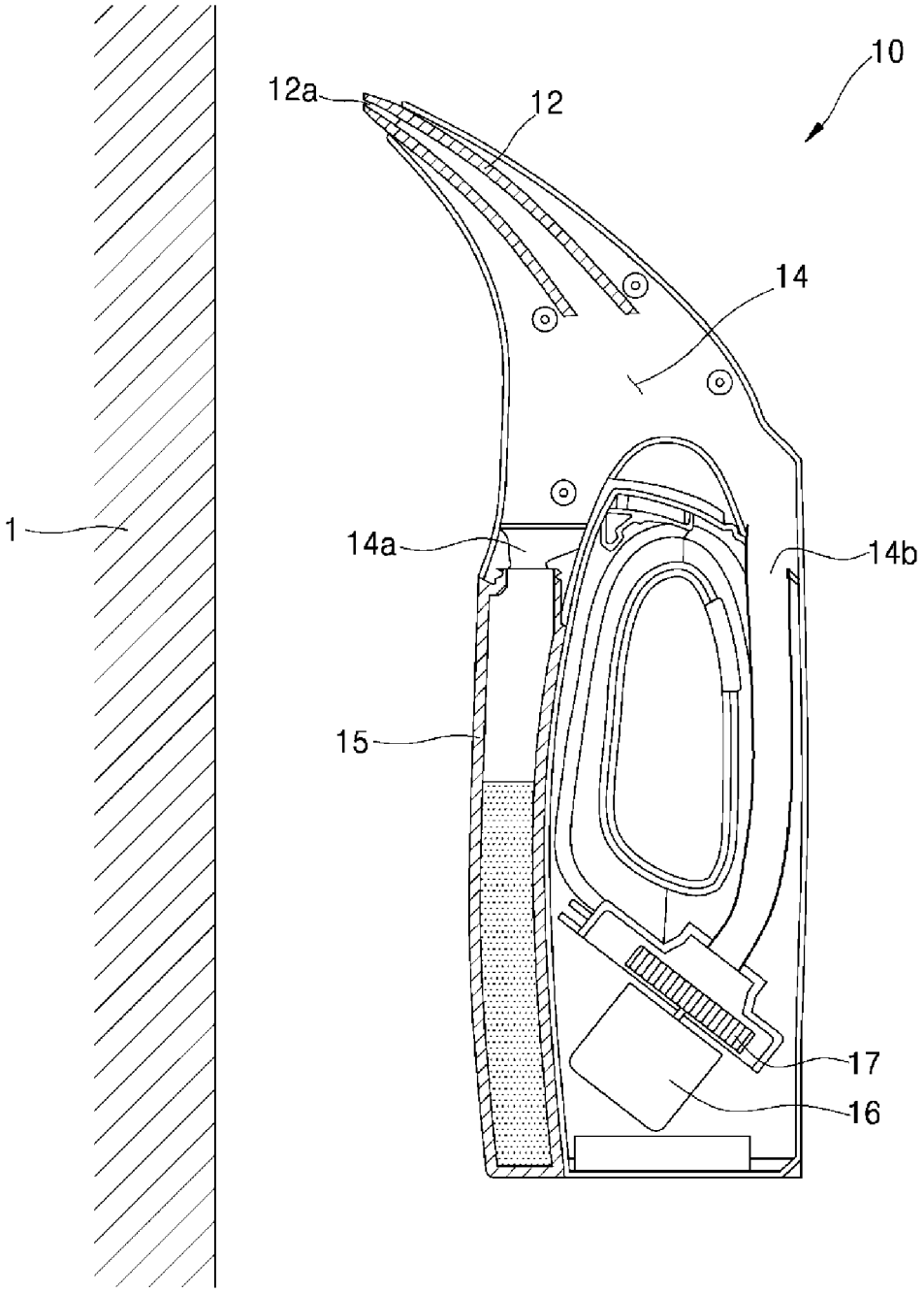
FIG. 2 is a view of an internal structure of a remaining water suction device in a state where water is removed from a wall surface by using the remaining water suction device.
Figure 3:
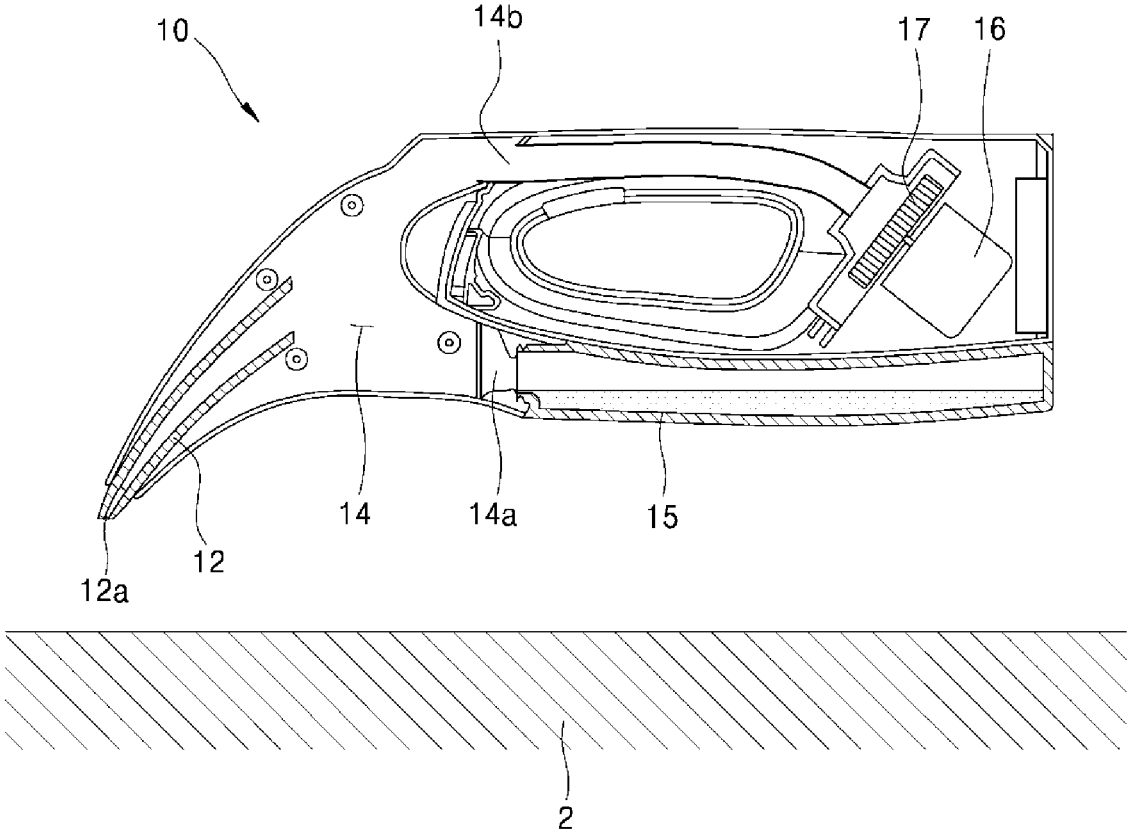
FIG. 3 is a view of an internal structure of a remaining water suction device in a state where water is removed from the floor by using the remaining water suction device.

In the water suction device 10 (FIG. 2) discussed above, the water tank 15 (FIG. 2) for storing water is disposed in the lower portion of the suction nozzle 12 (FIG. 2). However, in the water suction device 100-1 according to the first embodiment, the buffer tank 130 is provided, and the water storage tank 150 may be disposed at an opposite side as compared to the buffer tank 130. This structure may be advantageous in terms of securing a capacity of the water storage tank 150.

Additionally, the water storage tank 150 of the water suction device 100-1 may serve as a handle. That is, a handle hole (H) may be disposed at an inner side of the water storage tank 150. As a result, the water storage tank 150 may function as a handle and/or a structure for storing water. The design in which the handle hole H is disposed at an inner side of the water storage tank 150 may allow the user to grasp the water storage tank 150 when using the water suction device 100-1.

On the other hand, when water is filled in the water storage tank 150, the user may separate the water storage tank 150 from the water suction device 100-1 in order to discard the filled water. At this time, the user may not connect the water storage tank 150 to the water suction device 100-1 accidentally after the water storage tank 150 is emptied. Further, the user may use the water suction device 100-1 in a state where the water storage tank 150 is not engaged.

However, as discussed above, if the water storage tank 150 performs the function of handle, the water suction device 100-1 may not be grasped while the water storage tank 150 is separated. Therefore, a user may be prevented from mistakenly using the water storage tank 150 without the water storage tank 150 being attached.

The water storage tank 150 may be made of a transparent material or a semi-transparent material such that the amount of water stored in the water storage tank can be easily determined.

The water transfer pump 140 may move (or transfer) the water of the buffer tank 130 to the water storage tank 150. The water transfer pump 140 may be configured to always operate simultaneously with the suction motor 180 when the suction motor 180, is operated. The suction motor 180 may drive the suction fan 170.

Both the suction motor 180 and the water transfer pump 140 (of the water suction device 100-1) may use electric power of a storage battery 190. Thus, when the water transfer pump 140 is unnecessarily operated, an amount of use time can be shortened.

Accordingly, a water level sensor may be provided in the buffer tank 130 to more efficiently operate the water transfer pump 140. When a certain level of water is detected by the water level sensor, the water transfer pump 140 may operate for a prescribed time.

As another method for reducing power consumption of the water transfer pump 140, a method may be provided of intermittently operating the water transfer pump 140.

For example, when a time required for the suction motor 180 to operate in order to fill the buffer tank 130 with water is T seconds and when a time required for the water transfer pump 140 to operate in order to transfer the water filled in the buffer tank 130 to the water storage tank 150 is t seconds, then the water transfer pump 140 can operate for t seconds at intervals of T seconds when the suction motor 180 is operated.

Operation of the water suction device 100-1 may be described with reference to FIG. 5.

In the drawing(s), a dotted line may indicate or represent a water transfer path and an alternate long and short dash line may indicate or represent an air flow.

As shown in the drawing(s), air and water may be sucked and transferred together through the suction nozzle 110.

The air introduced through the discharge port 114 (of the suction nozzle 110) and into the water separation chamber 120 may be blocked (or partially blocked) by the partition wall 122, and the air may be divided into two streams such that one stream is directed toward the side of the water discharge port 125, and the other stream flows toward the side of the air discharge port 126.

The water introduced through the discharge port 114 (of the suction nozzle 110) and into the water separation chamber 120 may be blocked (or partially blocked) by the partition wall 122, and the water may flow downward along the surface of the partition wall 122 and into the buffer tank 130.

The air inside the water separation chamber 120 may be sucked into the air discharge port 126, so that the air beneath the partition wall 122 may flow from the water discharge port 125 toward the air discharge port 126.

FIG. 6 is a view for explaining an operation in a laid-down state of the water suction device according to the first embodiment. Other embodiments and configurations may also be provided.

Even if the water suction device 100-1 is in a laid-down state (or a laid-down position), the air flow may be the same as an example of being in a standing state (or a standing position), and therefore a duplicate description may not be provided.

The water flow inside the water suction device 100-1 may be generated by the flow of air and the gravity. When the water suction device 100-1 is laid down, the part where the water flows downward may change.

As shown in the drawing(s), the water introduced through the discharge port 114 (of the suction nozzle 110) may collide with the partition wall 122, and then the water may fall down below the partition wall 122. The water may then flow on an inner surface of an inner wall 123 of the water suction device 100-1.

Therefore, the inner surface of the inner wall 123 may be downwardly inclined toward the water discharge port 125 in a state where the water suction device 100-1 is laid down. Otherwise, water may not smoothly flow into the buffer tank 130.

The buffer tank 130 may have a water effusion port 132 through which water may be discharged. The water effusion port 132 may be connected to the water transfer pump 140 through a water pipe 142.

The water effusion port 132 may be provided at a corner portion that becomes a lower portion in both the standing state and the laid-down state.

This may smoothly discharge the water through the water effusion port 132 when the water suction device 100-1 is used in an upright position and when the water suction device 100-1 is used in a laid down position.

The water storage tank 150 may have a water inlet 152 through which the water of the water transfer pump 140 flows. The water inlet 152 (of the water storage tank 150) may be provided at a corner portion that becomes an upper portion when the water suction device 100-1 is provided in either one of the standing state and the laid-down state.

As shown in FIG. 5, the water inlet 152 is disposed in the outer side (i.e., right side of the upper portion of the water storage tank 150 of FIG. 5) when the water inlet 152 is described based on a standing state of the water suction device 100-1.

As shown in FIG. 6, the water inlet 152 is disposed in the upper portion of the front side (i.e., left side of the water storage tank 150 of FIG. 6) when the water inlet 152 is described based on a laid-down state of the water suction device 100-1.

When the water inlet 152 is disposed in a position excluding the upper portion, the water stored in the water storage tank 150 may flow back to the water inlet 152 and efficiency of the water transfer pump 140 may be reduced. When the discharge side of the water transfer pump 140 receives water pressure, the pump efficiency of the water transfer pump 140 may be reduced.

Figure 7:
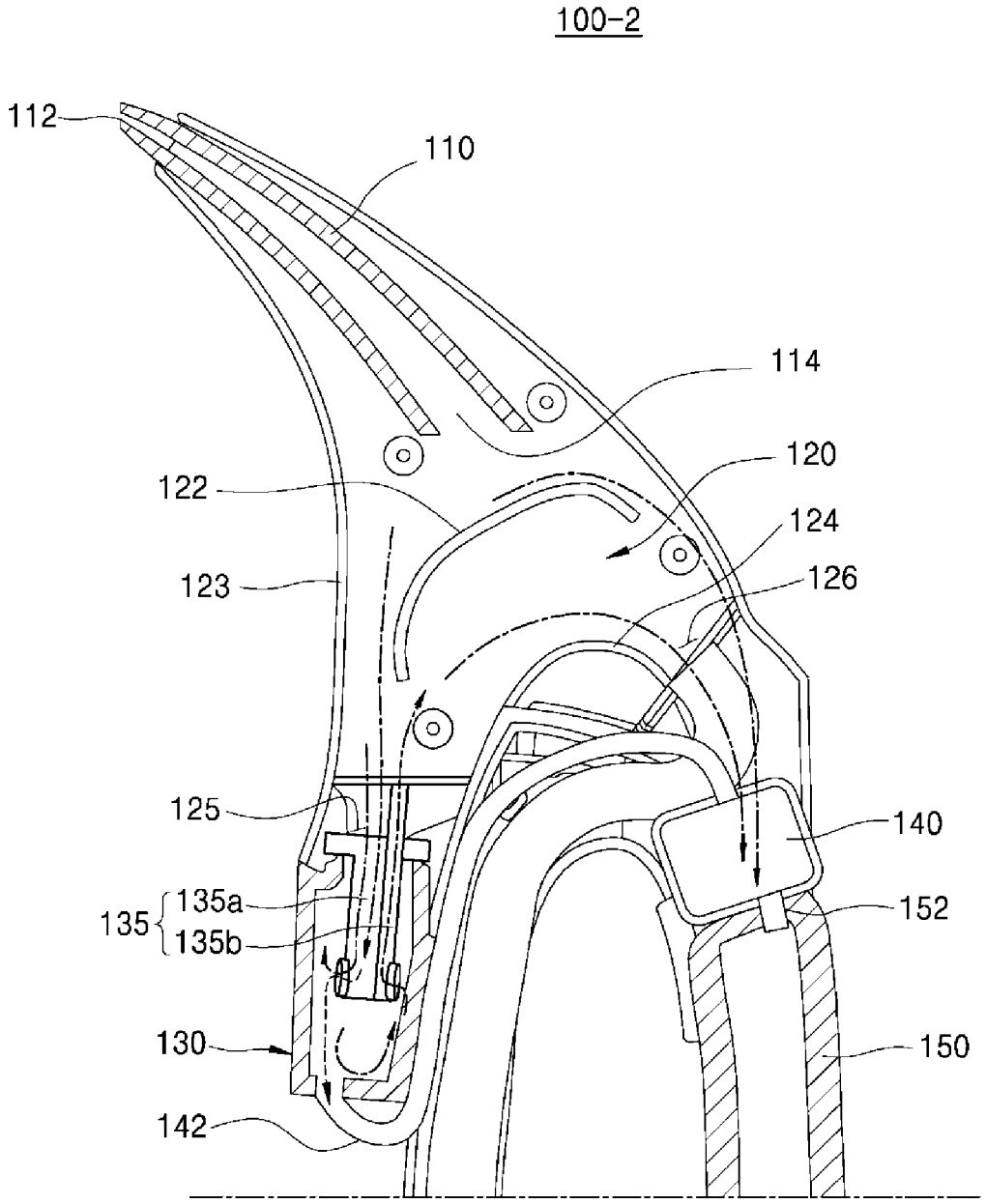
FIG. 7 is a view for explaining a structure of a remaining water suction device according to a second embodiment.

FIG. 7 is a view for explaining a structure of a remaining water suction device according to a second embodiment. Other embodiments and configurations may also be provided.

The remaining water suction device 100-2 (or water suction device) according to the second embodiment may include the suction nozzle 110, the water separation chamber 120, the buffer tank 130, the water transfer pump 140, the suction fan 170, the suction motor 180, and an air discharge pipe 135.

The water suction device 100-2 may include the air discharge pipe 135 that discharges the air inside the buffer tank 130 such that water can smoothly flow into the buffer tank 130.

Since the remaining elements, except for the air discharge pipe 135, may be the same as those of the water suction device 100-1 of the first embodiment, a duplicated description may not be provided.

The water separated from the water separation chamber 120 may flow into the buffer tank 130 due to the gravity and the flow of air. The water suction device 100-2 may include the air discharge pipe 135 that guides the air inside the buffer tank 130 to the water separation chamber 120.

The discharge pipe 135 may include a water guide pipe 135*a* and an air guide pipe 135*b*. The water guide pipe 135*a* may guide the water discharged from the water separating chamber 120 into the buffer tank 130. The air guide pipe 135*b* may guide the air inside the buffer tank 130 into the water separation chamber 120.

It may be preferable that the water separated from the water separation chamber 120 is not introduced into the air guide pipe 135*b*. Accordingly, an outlet of the air guide pipe 135*b* may be disposed at a position higher than an inlet of the water guide pipe 135*a*.

It may be preferable that the outlet of the water guide tube 135*a* and the inlet of the air guide tube 135*b* face the opposite direction or have a height difference in order to prevent the water discharged from the water guide pipe 135*a* from flowing into the inlet of the air guide pipe 135*b*.

The air discharge pipe 135 may be provided such that the water guide pipe 135*a* and the air guide pipe 135*b* are integrally formed to serve as a lid of the buffer tank 130. However, embodiments are not limited to this form. Like the air guide pipe 135*b*, the air discharge pipe 135 may be implemented as a single tube provided with an inlet in the interior of the buffer tank 130 and an outlet in the interior of the water separation chamber 120.

The air discharge pipe 135 may reduce pressure inside the buffer tank 130. When the internal pressure of the buffer tank 130 is reduced, velocity of the fluid (i.e., air and water) flowing into the buffer tank 130 may increase.

The air discharge pipe 135 may be provided with the inlet inside the buffer tank 130 and the outlet inside the water separation chamber 120.

The pressure inside the water separation chamber 120 may become lower as it approaches the air discharge port 126.

The inlet of the air discharge pipe 135 may be located inside the buffer tank 130, and the outlet may be located inside the water separation chamber 120. Thus, the pressure in the inlet portion may be relatively higher than the pressure in the outlet portion.

Therefore, when the air discharge pipe 135 is provided in the buffer tank 130 of the water suction device 100-2, the air inside the buffer tank 130 may be discharged to the interior of the water separation chamber 120 through the air discharge pipe 135 such that the pressure inside the buffer tank 130 is reduced. When the pressure inside the buffer tank 130 is reduced, velocity with which the water separated in the water separation chamber 120 flows into the buffer tank 130 may increase.

Figure 8:
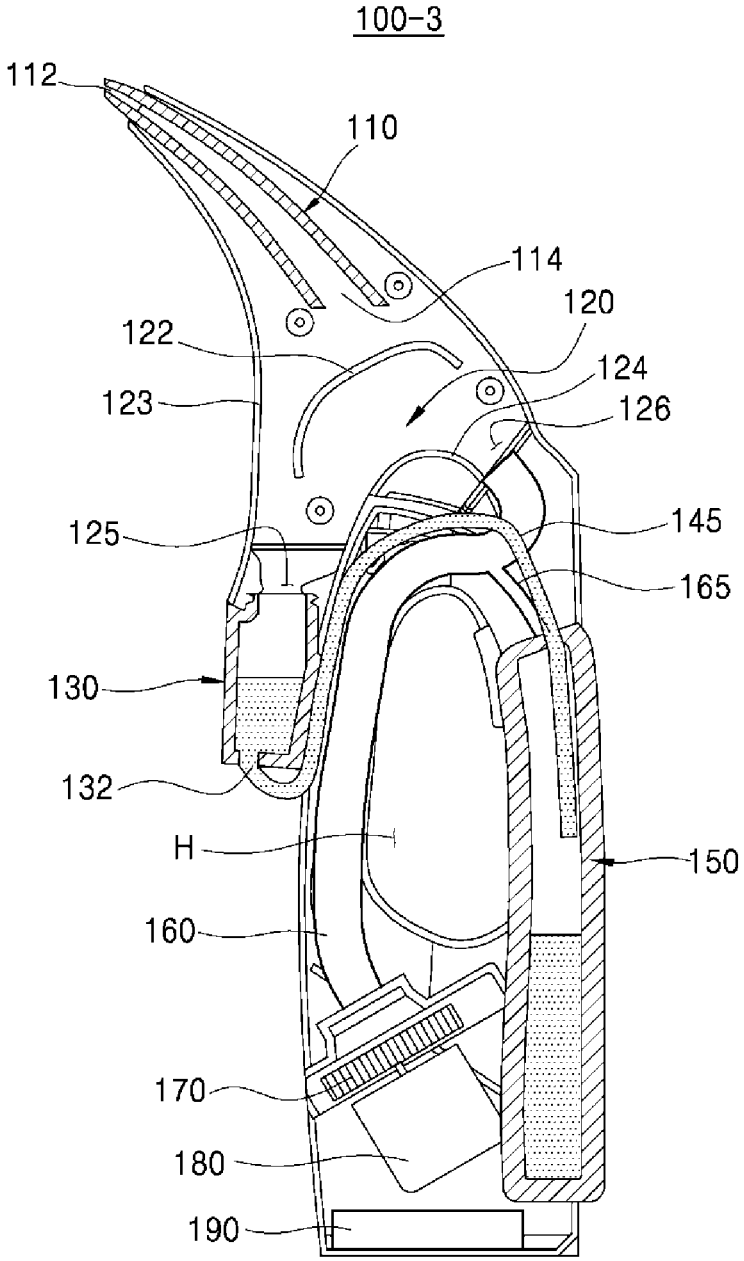
FIG. 8 is a cross-sectional view of a structure of a remaining water suction device according to a third embodiment.
Figure 9:
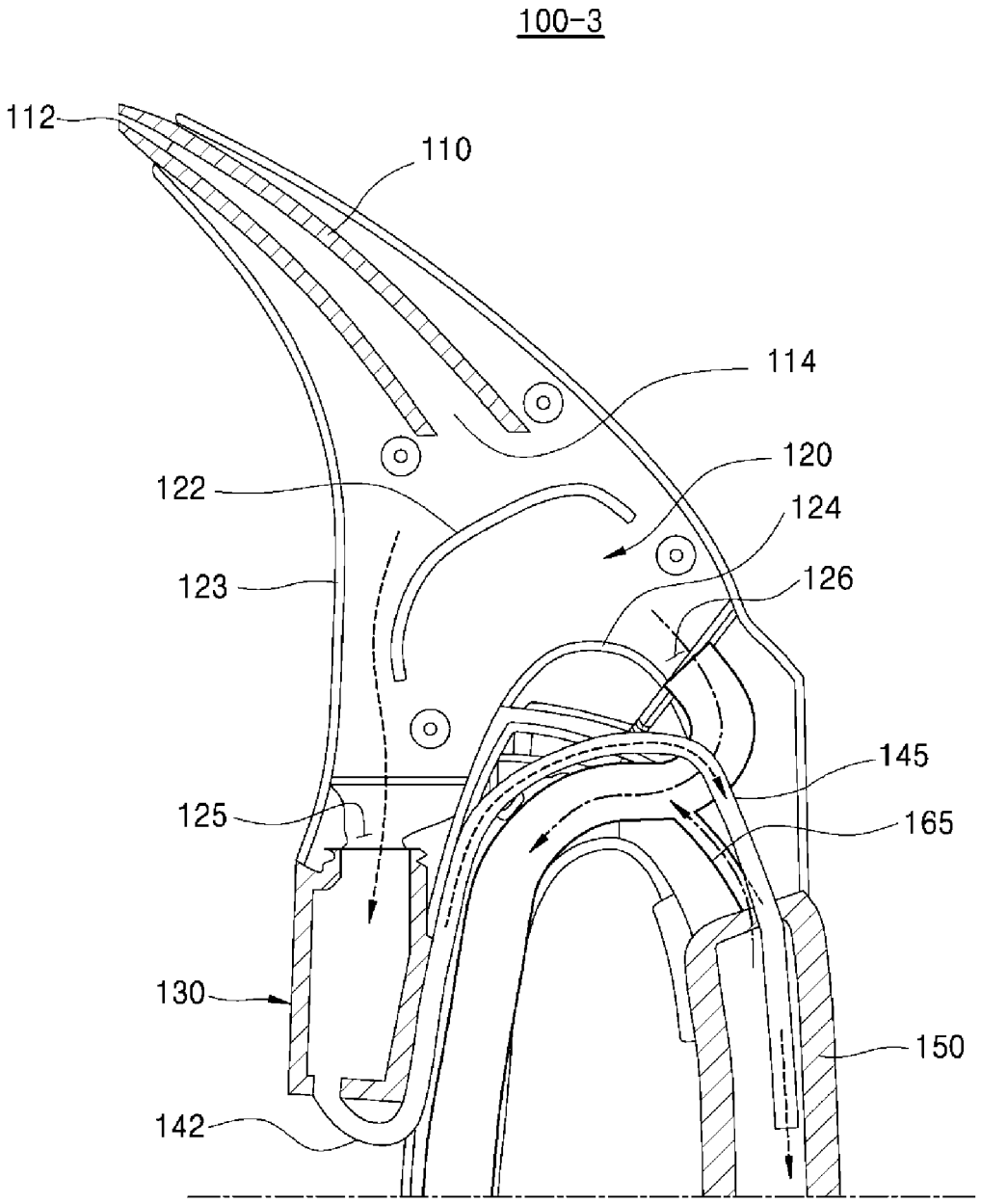
FIG. 9 is a view for explaining an operation principle of the remaining water suction device according to the third embodiment.

FIG. 8 is a cross-sectional view of a structure of a remaining water suction device according to a third embodiment. FIG. 9 is a view for explaining an operation principle of the water suction device according to the third embodiment. Other embodiments and configurations may also be provided.

The remaining water suction device 100-3 (or the water suction device) according to the third embodiment may include the suction nozzle 110, the water separation chamber 120, the buffer tank 130, the water storage tank 150, the suction pipe 160, the suction fan 170, the suction motor 180, and an auxiliary suction pipe 165.

Since the suction nozzle 110, the water separation chamber 120, and the buffer tank 130 may have the same configuration as described above, a duplicate description may not be provided.

The water suction device 100-3 may include the auxiliary suction pipe 165 connecting the water storage tank 150 and the suction pipe 160.

In the above-described embodiments, water in the buffer tank 130 may be transferred to the water storage tank 150 by using the power of the water transfer pump 140. The water suction device 100-3 may reduce the pressure of the water storage tank 150 to transfer the water in the buffer tank 130 to the water storage tank 150.

The water storage tank 150 may be connected to the suction pipe 160 through the auxiliary suction pipe 165. Since the inside of the suction pipe 160 may have a relatively low pressure, the air inside the water storage tank 150 may be sucked into the suction pipe 160 through the auxiliary suction pipe 165. Accordingly, internal pressure of the water storage tank 150 may be reduced.

The water storage tank 150 may be connected to the buffer tank 130 and a water pipe 145. Accordingly, when the pressure of the water storage tank 150 is reduced, the water stored in the buffer tank 130 may move to the water storage tank 150 due to pressure difference between the inside of the water storage tank 150 and the buffer tank 130.

The auxiliary suction pipe 165 may be implemented to suck only the air inside the water storage tank 150 into the suction pipe 160. The inlet of the auxiliary suction pipe 165 may be disposed in the upper end of the water storage tank 150.

The end of the water pipe 145 connected to the water storage tank 150 may protrude into the water storage tank 150. This may make the end of the water pipe 145 and the inlet of the auxiliary suction pipe 165 have a height difference, thereby preventing the water introduced through the water pipe 145 from being sucked up into the auxiliary suction pipe 165.

The water suction device may have the effect that the stored water does not flow back and is not spouted even if it is used in a laid-down position so as to suck the water on the floor. Accordingly, the user may be prevented from wiping off the spouted water or wetting the clothes due to the spouted water, thereby improving user satisfaction.

The water suction device may provide a structure for discharging the air inside the tank in which water is stored, thereby improving the water suction efficiency. Accordingly, the user can complete the work of removing the water on the floor even with less force in a shorter time than with a disadvantageous device, thereby improving user convenience.

The water suction device may enable the water storage tank (for storing the water) to serve as a handle. Additionally, when the user uses the water suction device, the amount of water stored in the water storage tank can be checked naturally, thereby improving ease of use.

Embodiments may solve the above problems, and provide a water suction device that reduces the problem that the sucked water flows backward and is expelled to the outside when the water is sucked from the wall surface or the floor.

Embodiments may provide a water suction device that improves a remaining water suction efficiency.

Embodiments may provide a water suction device that is prevented from being used in a state where a water tank is not mounted.

In accordance with an aspect, a remaining water suction device may include: a bottom body; a suction nozzle which is provided with a suction port and a discharge port; a water separation chamber which is connected to the discharge port of the suction nozzle and which is provided with a water discharge port and an air discharge port; a buffer tank which is connected to the water discharge port and which stores water separated from the water separation chamber; a water transfer pump which transfers the water stored in the buffer tank; a water storage tank which stores the water transferred through the water transfer pump; a suction fan which provides a suction force to the air discharge port; and a suction motor which drives the suction fan. The water separation chamber includes a partition wall which blocks the discharge port of the suction nozzle, and separates and guides a fluid introduced into the suction nozzle to the water discharge port side and the air discharge port side. The partition wall is disposed downwardly inclined toward the water discharge port side. An inner surface of the water discharge port side of the water separation chamber is inclined downward in an outer direction. The remaining water suction device further includes a water level sensor which detects a level of the buffer tank, wherein the water transfer pump operates according to a detection signal of the water level sensor. The remaining water suction device further includes an air discharge pipe which connects an interior of the buffer tank and the water separation chamber. The buffer tank includes a water effusion port which is connected to the water transfer pump, wherein the water effusion port is disposed in an inner lower portion of the buffer tank. The water storage tank includes a water inlet which is connected to the water transfer pump, wherein the water inlet is disposed in an external side of an upper portion of the water storage tank. The water storage tank is disposed in an external side of a handle hole.

In accordance with another aspect, a remaining water suction device may include: a suction nozzle which is provided with a suction port and a discharge port; a water separation chamber which is connected to the discharge port of the suction nozzle and which is provided with a water discharge port and an air discharge port; a buffer tank which is connected to the water discharge port and which stores water separated from the water separation chamber; a water storage tank which stores the water transferred through the water transfer pump; a water pipe which connects the buffer tank and the water storage tank; a suction pipe which is connected to the air discharge port; a suction fan which is connected to the suction pipe to provide a suction force; a suction motor which drives the suction fan; and an auxiliary suction pipe which connects the storage tank and the suction pipe. An outlet of the water pipe is disposed at a lower height than an inlet of the auxiliary suction pipe. The inlet of the auxiliary suction pipe is disposed in an external side of an upper portion of the water storage tank.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A water suction device comprising:

a suction nozzle that includes a suction port and a discharge port;

a water separation chamber coupled to the discharge port of the suction nozzle, and the water separation chamber to include a water discharge port and an air discharge port;

a buffer tank coupled to the water discharge port, and the buffer tank to store water separated from the water separation chamber;

a water transfer pump configured to transfer the water from the buffer tank;

a water storage tank configured to store the water from the buffer tank that is transferred by the water transfer pump;

a suction fan configured to provide a suction force to the air discharge port;

a suction motor configured to drive the suction fan; and an air discharge pipe coupled the water separation chamber and an interior of the buffer tank;

wherein the air discharge pipe includes a water guide pipe to guide water from the water separation chamber into the buffer tank, and an air guide pipe to guide air inside the buffer tank to the water separation chamber, and wherein the buffer tank is smaller than the water storage tank.

2. The water suction device of claim 1, wherein the water separation chamber includes a partition wall disposed at least partially in front of the discharge port of the suction nozzle, and the partition wall to guide a fluid introduced into the suction nozzle to at least a side of the water suction device associated with the water discharge port.

3. The water suction device of claim 2, wherein the partition wall is downwardly inclined toward the side of the water suction device associated with the water discharge port.

4. The water suction device of claim 1, wherein an inner surface of the water separation chamber is inclined downwardly in an outer direction.

5. The water suction device of claim 1, wherein the buffer tank includes a water effusion port coupled to the water transfer pump via a water pipe, wherein the water effusion port is provided at a lower portion of the buffer tank.

6. The water suction device of claim 1, wherein the water storage tank includes a water inlet coupled to the water transfer pump, wherein the water inlet is disposed at an external side of an upper portion of the water storage tank.

7. The water suction device of claim 1, comprising a handle hole when the water storage tank is attached to other parts of the water suction device.

8. A water suction device comprising:

a suction nozzle that includes a suction port and a discharge port;

a water separation chamber coupled to the discharge port of the suction nozzle, and the water separation chamber to include a water discharge port and an air discharge port;

a buffer tank coupled to the water discharge port, and the buffer tank to store water separated from the water separation chamber;

a water storage tank configured to store the water from the buffer tank that is transferred through a water transfer pump;

a water pipe to couple between the buffer tank and the water storage tank;

a suction pipe coupled to the air discharge port;

a suction fan coupled to the suction pipe to provide a suction force;

a suction motor configured to drive the suction fan; and an auxiliary suction pipe coupled between the water storage tank and the suction pipe, wherein an outlet of the water pipe in the water storage tank is disposed at a lower height in the water storage tank than an inlet of the auxiliary suction pipe in the water storage tank, and wherein the buffer tank is smaller than the water storage tank.

9. The water suction device of claim 8, wherein the inlet of the auxiliary suction pipe is externally disposed from an upper portion of the water storage tank.

10. A water suction device comprising:

a suction nozzle;

a water separation chamber to couple to the suction nozzle, and the water separation chamber to have a water discharge port and an air discharge port;

a buffer tank to store water received from the water separation chamber;

a water storage tank to store water;

a water transfer pump to transfer the water from the buffer tank to the water storage tank via a water pipe;

a suction fan to provide a suction force to the air discharge port, and to provide an air flow through the air discharge port; and an air discharge pipe coupled between the water separation chamber and the buffer tank, wherein the air discharge pipe includes a water guide pipe to guide water from the water separation chamber into the buffer tank, and an air guide pipe to guide air inside the buffer tank to the water separation chamber, and wherein the buffer tank is smaller than the water storage tank.

11. The water suction device of claim 10, wherein the water separation chamber includes a partition to guide a fluid from the suction nozzle and into the water discharge port side.

12. The water suction device of claim 10, wherein the water guide pipe and the air guide pipe are integrally formed to serve as a lid of the buffer tank.

13. The water suction device of claim 10, comprising a suction pipe between the air discharge port and the suction fan, and an auxiliary suction pipe coupled between the water storage tank and the suction pipe.

* * * * *